US010443020B2

(12) United States Patent
Bandyopadhyay et al.

(10) Patent No.: US 10,443,020 B2
(45) Date of Patent: Oct. 15, 2019

(54) HARD SURFACE CLEANING COMPOSITION

(71) Applicant: Conopco, Inc., Englewood Cliffs, NJ (US)

(72) Inventors: Punam Bandyopadhyay, Bangalore (IN); Jiji Paul Kottukapally, Bangalore (IN); Maheshwara Shiva Naik, Bangalore (IN)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 15/778,962

(22) PCT Filed: Nov. 16, 2016

(86) PCT No.: PCT/EP2016/077890

§ 371 (c)(1),
(2) Date: May 24, 2018

(87) PCT Pub. No.: WO2017/093023

PCT Pub. Date: Jun. 8, 2017

(65) Prior Publication Data

US 2018/0355281 A1 Dec. 13, 2018

(30) Foreign Application Priority Data

Dec. 2, 2015 (EP) ..... 15197458

(51) Int. Cl.

| | |
|---|---|
| ***C11D 1/22*** | (2006.01) |
| ***C11D 1/29*** | (2006.01) |
| ***C11D 1/37*** | (2006.01) |
| ***C11D 3/00*** | (2006.01) |
| ***C11D 3/20*** | (2006.01) |
| ***C11D 11/00*** | (2006.01) |

(52) U.S. Cl.

CPC ..... *C11D 1/22* (2013.01); *C11D 1/29* (2013.01); *C11D 1/37* (2013.01); *C11D 3/0026* (2013.01); *C11D 3/0094* (2013.01); *C11D 3/2079* (2013.01); *C11D 3/2086* (2013.01); *C11D 11/0035* (2013.01)

(58) Field of Classification Search

CPC ..... C11D 1/22

See application file for complete search history.

(56) References Cited

U.S. PATENT DOCUMENTS

| | | | | |
|---|---|---|---|---|
| 3,919,111 | A * | 11/1975 | Heyden | B01D 19/04 510/218 |
| 5,262,079 | A | 11/1993 | Kacher | |
| 5,695,573 | A | 12/1997 | Becker | |
| 2004/0076614 | A1 | 4/2004 | Schur | |
| 2006/0111266 | A1 | 5/2006 | Abera et al. | |
| 2010/0047202 | A1 | 2/2010 | Goddinger et al. | |
| 2010/0069400 | A1 | 3/2010 | Malstrom et al. | |
| 2014/0323386 | A1* | 10/2014 | Matsuzawa | A61Q 19/10 510/488 |
| 2015/0191676 | A1* | 7/2015 | Liu | C11D 1/29 510/340 |

FOREIGN PATENT DOCUMENTS

| | | |
|---|---|---|
| WO | WO9827189 | 6/1998 |
| WO | WO2008080701 | 7/2008 |
| WO | WO10018418 | 2/2010 |
| WO | WO12020075 | 2/2012 |
| WO | WO2013160265 | 10/2013 |
| WO | WO14078849 | 5/2014 |

OTHER PUBLICATIONS

Search Report and Written Opinion in EP15197458; dated May 13, 2016.

Search Report and Written Opinion in PCTEP2016077890; dated Jan. 31, 2017.

* cited by examiner

*Primary Examiner* — Necholus Ogden, Jr.

(74) *Attorney, Agent, or Firm* — Greenberg Traurig, LLP

(57) ABSTRACT

The invention is in the field of cleaning compositions. There is need for compositions that foam copiously when articles are washed. However the foam should rinse-off as quickly as possible in minimum number of rinses-cylces so that the process becomes sustainable. Disclosed is an aqueous cleaning composition comprising: (i) total Active Detergent (AD) level of 5 to 30% by weight, of which at least one-third is non-soap anionic surfactant; and, (ii) 0.1 wt % to 2 wt % of an antifoaming system containing saturated hydroxy fatty acid and saturated non-hydroxy $C_{14-18}$ fatty acid, where the ratio between the amount of said saturated hydroxy fatty acid to that of said saturated non-hydroxy $C_{14-18}$ fatty acid is from 1:0.75 to 1:5 parts by weight and where the pH of said composition is from 2 to 7.

9 Claims, No Drawings

HARD SURFACE CLEANING COMPOSITION

FIELD OF THE INVENTION

The present invention is in the field of hard surface cleaning, more particularly dishwash compositions containing rinse-activated antifoaming agents.

BACKGROUND OF THE INVENTION

Water is becoming scarcer, especially in developing countries. As a result, there is need to save water in as many ways as possible.

Foam is usually associated with cleaning products such as laundry detergent compositions and dishwash compositions. Products that foam copiously during the pre-rinse cleaning stage, or in other words, the ones which have greater foaming ability, are perceived to be better than the ones that foam less. Consumers do prefer products that foam copiously. On the other hand, it is also necessary to rinse the articles with clean water so that the foam subsides. Most consumers tend to rinse until there is no visible sign of foam and usually four to five rinse-cycles is the norm. However, such a practice is not sustainable because substantial amount of fresh water is necessary for each rinse-cycle. Therefore there is need for compositions which foam copiously during pre-rinse stage, but which could be rinsed off with minimal water.

Conventional antifoam agents like silicones and soap are good defoamers but they affect the foam volume during pre-rinse stage.

WO9827189 A1 discloses a mildly acidic laundry detergent composition containing rinse-activated antifoam ingredients. The composition has an anionic surfactant and/or at least one non-ionic surfactant. Also present is a rinse-active, pH sensitive, foam control agent which comprises a fatty acid. Upon rinsing, at least a portion of the fatty acid converts into soap to suppresses the foam. The fatty acid may be saturated or unsaturated and preferably is lauric, myristic, oleic, stearic, palmitic or tallow fatty acid. Even fatty acids are used as antifoam agents.

US2015/0191676 A1 (P&G) discloses a liquid laundry detergent composition containing an alkyl ethoxy sulphate surfactant along with two or more fatty acids characterized by a specific fatty acids distribution profile as rinse-activated antifoam agents. The composition contains 0.1 wt % to 4 wt % of two or more fatty acids or salts where $C_{14}$ component forms 30% to 90% of the total fatty acid content.

Our co-pending unpublished European application EP 14182852.5 (Unilever) discloses a dishwash composition containing rinse-activated antifoaming system containing lauric acid and stearic acid.

U.S. Pat. No. 3,919,111 B1 (Henkel, 1975) discloses foam-control using mono or diester of hydroxystearyl alcohol with a saturated fatty acid or hydroxy fatty acid having from 15 to 24 carbon atoms dispersed in an organic solvent or water.

US2014/0323386 A1 (The Nisshin Oillio Group Ltd) discloses the use of polymerised hydroxyl stearic acid and an esterification reaction product of the polymer in detergent products for rinse-activated foam control.

While fatty acids are used for rinse benefits, i.e., in order to reduce the number of rinse-cycles, any indiscriminate increase in their amount is counterproductive. In particular, the use of fatty acids may render the compositions unstable and such compositions are prone to phase separation.

In one publication, WO2013160265 A1 (Henkel), hydroxyl fatty acids are used as foam stabilisers.

Therefore there is an unmet need for compositions which have more efficient rinse-activated antifoaming system.

It is an object of the present invention to provide a cleaning composition, especially a dishwashing composition, which provides high foam-volume during the washing or the pre-rinse stage but which requires lesser than the usual number of rinse-cycles for the foam to subside.

It has been determined that the object can be met by a rinse-activated antifoaming system comprising a hydroxy fatty acid and a non-hydroxy fatty acid.

SUMMARY OF THE INVENTION

In accordance with a first aspect is disclosed an aqueous cleaning composition comprising:

(i) total Active Detergent (AD) level of 5 to 30% by weight, of which at least one-third is non-soap anionic surfactant; and, (ii) 0.1 wt % to 2 wt % of an antifoaming system containing saturated hydroxy fatty acid and saturated non-hydroxy $C_{14-18}$ fatty acid, where the ratio between the amount of said saturated hydroxy fatty acid to that of said saturated non-hydroxy $C_{14-18}$ fatty acid is from 1:0.75 to 1:5 parts by weight and where the pH of said composition is from 2 to 7.

These and other aspects, features and advantages will become apparent to those of ordinary skill in the art from a reading of the following detailed description and the appended claims.

DETAILED DESCRIPTION OF THE INVENTION

Aqueous cleaning compositions invariably contain surfactants or surface-active agents. These may be anionic, non-ionic, cationic or zwitterionic. Surfactants are necessary because they primarily are responsible for cleaning the articles. The total amount of surfactants is variable and it depends on the intended application as well the selling price of the product.

Dishwash compositions are available in various formats. These include powders, pastes, liquids and bars. Of all these formats, powders contain least amount of surfactants while liquids contain the most.

The total surfactant content is generally expressed as the total Active Detergent (AD) level. Powders are usually 2 to 4 AD products whereas dishwash or detergent liquids may be 5 to 30 AD products.

In addition to surfactants which determine the AD level, such compositions also contain other additives like foam boosters, foam suppressants (or antifoam agents), hydrotropes, polymers, colour and perfume.

Cleaning compositions like detergents and dishwash compositions usually contain combination of different surfactants where each surfactant is meant to perform a definite purpose. The primary purpose of any surfactant is to act on soil/dirt present on the article to be cleaned.

Surfactants generate foam and the amount of foam or the foam volume varies according to type of the surfactant. Anionic surfactants usually foam the most. Detergent compositions and dishwash composition contain substantial amount of anionic surfactants. Therefore such compositions tend to generate copious amount of foam during the washing stage when articles are contacted with the composition or a diluted form thereof.

The volume of foam is usually associated with the efficacy of the product. Consumers prefer high-foaming products.

On the other hand, after the wash-cycle is over, the articles need water for rinsing. Generally, the articles are rinsed three to four times, each time with a fresh load of clean water. Each time an article is rinsed, it constitutes one rinse-cycle.

It is known to include a material which reduce the formation of foam either during the washing stage or during the rinse cycles. This is done to allow the foam to subside as quickly as possible. In other words, the motive is to reduce the number of rinse-cycles.

Compositions in accordance with this invention provide high foam-volume during the washing or the pre-rinse stage but requires lesser than the usual number of rinse-cycles for the foam to subside. The solution lies in use of a rinse-activated antifoaming system comprising a hydroxy fatty acid and a non-hydroxy fatty acid.

The Compositions in Accordance with this Invention

Compositions in accordance with this invention are aqueous. It is preferred that the compositions comprise 60 to 90% by weight water, more preferably 65 to 80% by weight water.

The total Active Detergent (AD) level of compositions in accordance with this invention is 5 to 30% by weight, of which at least one-third is non-soap anionic surfactant. In other words, the total surfactant content is 5 to 30% by weight. Of the total surfactant content, at least one-third is non-soap anionic surfactant. For example, if the total AD level is 18% by weight, then the minimum amount of non-soap anionic surfactant is 6% by weight. The balance may be other surfactants.

The term 'non-soap anionic surfactants' is known to persons who are skilled in the art of detergent manufacture. Soaps are salts, usually sodium salts, of fatty acids and they constitute a class of anionic surfactants. Soaps are prepared by neutralisation of fatty acids with an alkali or by transesterification of oils, generally vegetable oils.

There may be one anionic surfactant or alternatively a mixture of two or more non-soap anionic surfactants collectively making up for the one-third.

It is preferred that in the compositions according to the invention, the total Active Detergent level is 8 to 24% by weight. It is further preferred that of the total AD level, at least two-third is non-soap anionic surfactant. For example if the total AD level is 18% by weight, then the minimum amount of non-soap anionic surfactant is 12% by weight. It is further preferred that at least 80% of the Active Detergent (AD) is non-soap anionic surfactant. Further more preferably at least 90% of the Active Detergent (AD) is non-soap anionic surfactant The non-soap anionic surfactant can be an alkylbenzene sulphonate, an ethoxylated sulphate, primary alcohol sulphate, an ester sulphonate or an alpha olefin sulphonate. It is preferred that the non-soap anionic surfactant is at least one of a linear alkyl benzene sulphonate or an ethoxylated sulphate. Alternatively it is preferred that the anionic surfactant is a mixture of linear alkyl benzene sulphonate and ethoxylated sulphate.

When not all of the AD level is made up of non-soap anionic surfactants, one or more of nonionic surfactants, cationic surfactants or zwitterionic surfactants may constitute the balance of the AD. Suitable amphoteric surfactants include cocoamidopropyl betaine (CAPB), coco amido propyl amine oxide (CAPAO), cocodiethanol amide (CDEA) and cocomonoethanol amide (CMEA). Most preferred amphoteric surfactant is cocoamidopropyl betaine.

It is preferred that the alkylbenzene sulphonate is a linear alkylbenzene sulphonate having alkyl chain length of $C_8$-$C_{20}$. Generally the counter ion for anionic surfactants is an alkali metal, typically sodium, although instead of alkali metals, other amine based counter ions can also be present. Preferred linear alkyl benzene sulphonate surfactants include sodium salt of alkyl benzene sulphonates with an alkyl chain length of from 8 to 15, more preferably 12 to 14.

The general formula of ethoxylated sulphates is $RO(C_{21}H_4O)_xSO_3^-M^+$ where R is an alkyl chain having from 10 to 22 carbon atoms, saturated or unsaturated, M is a cation which makes the compound water-soluble, especially an alkali metal, ammonium or substituted ammonium cation, and x averages from 1 to 15. Preferably R is an alkyl chain having from 12 to 16 carbon atoms, M is sodium and x averages from 1 to 3, preferably x is 1; This is the anionic surfactant sodium lauryl ether sulphate (SLES). It is the sodium salt of lauryl ether sulphonic acid in which the predominantly C12 lauryl alkyl group has been ethoxylated with an average of 1 to 3 moles of ethylene oxide per mole.

The compositions in accordance with this invention may comprise a non-ionic surfactant, which may constitute either solely or in combination with other surfactants, the remainder of the AD level.

Preferred nonionic surfactants include condensation products of a higher alcohol (e.g., an alkanol containing about 8 to 18 carbon atoms in a straight or branched chain configuration) with about 5 to 30 moles of ethylene oxide; for example lauryl or myristyl alcohol condensed with about 16 moles of ethylene oxide (EO). Particularly preferred is Lauryl alcohol condensed with 5, 7 or 9 moles of ethylene oxide (Laureth 5, Laureth 7 and Laureth 9). Condensates of 2 to 30 moles of ethylene oxide with sorbitan mono- and tri $C_{10}$-$C_{20}$ alkanoic acid esters having HLB of 8 to 15 also may be used as nonionic surfactant. These surfactants are well known and are available under the Tween® trade name. Suitable surfactants include polyoxyethylene (4) sorbitan monolaurate, polyoxyethylene (4) sorbitan monostearate, polyoxyethylene (20) sorbitan trioleate and polyoxyethylene (20) sorbitan tristearate.

Antifoaming System

Compositions in according to the invention comprise 0.1 wt % to 2 wt % of an antifoaming system containing a saturated hydroxy fatty acid and a saturated non-hydroxy $C_{14-18}$ fatty acid. The ratio between the amount of the saturated hydroxy fatty acid to the saturated non-hydroxy $C_{14-18}$ fatty acid is from 1:0.75 to 1:5 parts by weight. It is preferred that the saturated hydroxy fatty acid is a mono-hydroxy fatty acid. It is further preferred that the saturated hydroxy fatty acid is 12-hydroxy stearic acid (abbreviated as 12-HSA).

In preferred compositions according to the invention, the saturated non-hydroxy $C_{14-18}$ fatty acid is a single acid. Alternatively, it is a combination of two or more $C_{14-18}$ fatty acids. Hysteric acid is commercially available mixture from Godrej, India. It is approximately a 50:50 mixture of palmitic acid (C16) and stearic acid (C18). Such mixtures are useful and preferred ingredients in view of the commercial availability.

Without wishing to be bound by theory, it is believed that the two types of acids combine to perform a function which they are unable to perform on their own, even at higher levels. It is believed that the hydroxy acid helps maintain the initial foam volume while the non-hydroxy fatty acid is activated during rinse cycles.

It is preferred that the composition comprises 0.1 to 1% by weight of the antifoam system. It is also preferred that the ratio is in the range of 1:0.75 to 1:2.

The pH of the Composition

The pH of the compositions in accordance with this invention is 2 to 7, preferably 4.5 to 6.5, more preferably 5 to 6.5 and most preferably 5.5 to 6.

Foaming Ability of the Compositions

The foaming ability of the compositions in accordance with the invention may be determined by any suitable method known in the art.

The Cylinder Shake method is usually the most suited for such applications but other methods may also be used. This procedure is used to determine the ability of foam solutions to foam and how quickly the foam subsides.

A fixed amount of the composition (diluted with water) is poured into a graduated cylinder. The cylinder is stoppered. It is then inverted a number of times and then the foam volume is determined in ml.

Preferably, the foam volume is determined as follows:

A test solution of the concerned composition (6.25 g/1) is prepared using 24 F.H. water. Fifty ml of this solution is transferred to a 250 ml graduated glass cylinder. The solution is shaken by first covering the cylinder with its lid and by inverting the cylinder ten times. Then it is placed on the flat surface of a table for one minute to allow the aqueous layers to separate. Thereafter, the solution is shaken one more time to allow the foam to even out.

The foam volume is then recorded by excluding aliquot water. It is recorded as initial foam or foam during the washing/pre-rinse stage.

To measure the foam at the end of each rinse cycle, the aliquot water is decanted along the sides of the cylinder while allowing the foam to be retained therein. Fifty ml of fresh 24 F.H. water is added along the sides of the cylinder. The solution is shaken and the foam volume is measured again as described earlier. The rinse-cycle is repeated until the foam volume is found to be 10 ml or less than that.

The initial foam volume of a control composition (i.e., composition devoid of hydroxy fatty acid as well as the non-hydroxy fatty acid) is taken as the standard or desired volume.

The initial foam is measured in the case of each experimental composition and is compared against the foam volume of the control composition. While a difference of 10 units in the volume is acceptable, any greater difference is not.

According in a preferred aspect of the invention is disclosed an aqueous cleaning composition comprising:

(i) total Active Detergent (AD) level of 5 to 30% by weight, of which at least one-third is non-soap anionic surfactant; and, (ii) 0.1 wt % to 2 wt % of an antifoaming system containing saturated hydroxy fatty acid and saturated non-hydroxy $C_{14-18}$ fatty acid, where the ratio between the amount of said saturated hydroxy fatty acid to that of said saturated non-hydroxy $C_{14-18}$ fatty acid is from 1:0.75 to 1:5 parts by weight and where the pH of said composition is from 2 to 7, wherein foam volume of said composition during pre-rinse stage as determined by Cylinder Shake method, is at least 145 ml and said foam volume subsides to 10 ml or less within three rinse-cycles.

Optional Ingredients

In addition to the ingredients described earlier, the compositions in accordance with the invention may comprise other known ingredients which are hereinafter described in details.

Water Insoluble Particles

It is preferred that the cleaning compositions of the invention comprises insoluble particulate matter. Such particulate matter may include an abrasive. The compositions may contain one type of particulate matter or a mixture of different particles while still being inside the range of up to 10 to 15% by weight of the composition.

Whenever such particles are present, it is preferred that Moh's index of such particulate matter is in the range of 2.5 to 7.0. The particulate matter could be one or more of calcite, dolomite, feldspar, silica, aluminium oxide, amalgam, anatase, apatite, boron carbide, corundum (natural aluminium oxide), crystolon, cuttlebone, diamond, diopside, emery, enamel, enstatite, fluorite, garnet, glass bead, glass, hematite, kyanite, magnetite, olivine, orthoclase, petalite, porcelain, feldspathic, pyrite, pumice, quartz, silica sand, silicon carbide, spinel, spodumene, staurolite, topaz, titanium dioxide, tungsten carbide, zirconium silicate, zirconia, particulate zeolites, borates, sulphates or a polymeric material such as polyethylene. Whenever present, the average particle size of such particles is 0.5 μm to 400 μm, more preferably 10 μm to 200 μm.

The composition according to the invention may contain other ingredients which aid in the cleaning or sensory performance. These include various other optional ingredients such as thickeners, colorants, preservatives, polymers, anti microbial agents, perfumes, pH adjusters, sequesterants, alkalinity agents and hydrotropes.

Use and Method

The method of cleaning any hard surface such as soiled dishes using the compositions of the invention is not different from the usual method. In particular, such a method would include a step of contacting a soiled article, such as a plate, with an efficacious amount of the composition of the invention, preferably with the help of a scrubber or implement such as sponge, scouring pad or cloth, followed by scrubbing and later by rinsing with water until foam volume subsides to 10 ml or less and this will happen within three rinse-cycles.

Alternatively, the cleaning compositions of the invention may be made available to users in the form of a pre-impregnated implement.

While the aqueous cleaning compositions according to the invention are generally suitable for use in dish wash applications for manual or machine assisted cleaning, the compositions may also be used for other related applications like fabric cleaning and general hard surface cleaning.

The invention will be explained with the help of the following non-limiting examples.

EXAMPLES

Two different dishwash compositions containing just basic minimum ingredients (therefore termed herein as base compositions) were prepared. The compositions were prepared because they represent the two basic formulations of dishwash compositions which are widely used. The formulations are shown in table 1.

TABLE 1

Table 1: Formulations of Base Composition 1 and 2 (BC1, BC2)

| Ingredient | BC1 % by weight | BC2 % by weight |
|---|---|---|
| Linear Alkylbenzene Sulfonic acid, Sodium salt | 9 | — |
| Sodium Lauryl ether sulphate 1EO (70% active) | 9 | 9.0 |
| Coco Amido Propyl Betaine (30% active) | — | 1.5 |
| Sodium Hydroxide (50% active) | 2.4 | — |
| Water and other minors | to 100 | to 100 |
| pH | 6.0 | 5.5 |
| Total Active Detergent level (AD) | 18 | 10.5 |

For the purpose of experiments on foamability, varying levels of hydroxy fatty acid and of non-hydroxy fatty acid were added to each of the base compositions. Details thereof are shown in tables 2 and 3. All the formulations so obtained were subjected to foam volume study by the Cylinder Shake method already described earlier.

All observations pertaining to the experiments on Base Composition 1 are summarised in table 2.

All observations pertaining to the experiments on Base Composition 2 are summarised in table 3.

Note:

The following abbreviations are used in tables 2 and 3:

(i) PR foam volume at pre-rinse stage (ii) 12 HSA 12-hydroxy stearic acid

TABLE 2

| Example No. | Details of the formulation | PR 0 | Foam volume at rinse-cycle 1 | 2 | 3 | 4 | 5 | Number of rinse cycles for foam to subside ≤10 ml |
|---|---|---|---|---|---|---|---|---|
| 1 | BC1 | 145 | 150 | 140 | 80 | 40 | 10 | 5 |
| 2 | BC1 + 0.25% 12-HSA | 160 | 170 | 150 | 70 | 10 | — | 4 |
| 3 | BC1 + 0.5% 12-HSA | Unstable Product | | | | | | NA |
| 4 | BC1 + 1% 12-HSA | Unstable Product | | | | | | NA |
| 5 | BC1 + 0.25% stearic acid | 140 | 140 | 130 | 70 | 35 | 10 | 5 |
| 6 | BC1 + 0.5% stearic acid | 120 | 80 | 10 | — | — | — | 2 |
| 7 | BC1 + 0.5% lauric acid | 147 | 130 | 110 | 55 | 19 | 10 | 5 |
| 8 | BC1 + 0.25% 12-HSA + 0.25% stearic acid | 150 | 145 | 60 | 0 | — | — | 3 |
| 9 | BC1 + 0.25% 12-HSA + 0.25% hysteric acid | 150 | 140 | 50 | 0 | — | — | 3 |
| 10 | BC1 + 0.5% 12-HSA + 0.5% lauric acid | 150 | 160 | 130 | 50 | 14 | 0 | 5 |
| 11 | BC1 + 0.5% 12-HSA + 0.5% stearic acid | 145 | 130 | 24 | 0 | — | — | 3 |
| 12 | BC1 + 0.5% 12-HSA + 0.5% hysteric acid | 145 | 110 | 18 | 0 | — | — | 3 |

Examples 1 to 7 and 10 are outside the scope of the invention while the others are inside the invention.

The data in table 1 indicates that just the base composition does not provide any rinse benefit because the foam volume subsides to ≤10 ml only after five full rinse-cycles. Addition of 0.25% by weight 12-HSA provides only one rinse benefit. An increase in 12-HSA makes the product unstable (Examples 3 and 4). This indicates that rinse benefits are not directly proportional to the amount of the hydroxy fatty acid and any arbitrary increase does not provide any technical benefit.

On the other hand, even the non-hydroxy fatty acids, alone, do not provide the desired technical effects.

For example, at 0.25% by weight, stearic acid (C18 carboxylic acid) does not provide even a single rinse benefit as compared to the base composition (Example 5). More amount of stearic acid starts affecting the initial foam adversely (foam volume 120 at the washing/pre-rinse stage), although only two-rinse cycles are sufficient (Example 6). Lauric acid at 0.5% by weight is practically of no use insofar as rinse benefits are concerned.

The data pertaining to Examples 8, 9, 11 and 12 (all within the scope of the invention) is clearly convincing insofar as both the benefits, i.e., initial foam and rinse benefits are concerned.

Example 10 (outside the invention) provides just a single rinse benefit. This indicates that although a combination of hydroxy and non-hydroxy fatty acids is necessary, the non-hydroxy fatty acid needs to be selective.

TABLE 3

| Example No | Details of the formulation | PR 0 | Foam volume at rinse-cycle 1 | 2 | 3 | 4 | 5 | 6 | Number of rinse cycles for foam to subside ≤10 ml |
|---|---|---|---|---|---|---|---|---|---|
| 13 | BC2 | 135 | 135 | 130 | 115 | 75 | 40 | 10 | 6 |
| 14 | BC2 + 0.25% 12-HSA | 130 | 130 | 70 | 40 | 10 | — | — | 4 |
| 15 | BC2 + 0.5% 12-HSA | Unstable Product | | | | | | | |
| 16 | BC2 + 0.25% stearic acid | 130 | 130 | 130 | 100 | 50 | 20 | 10 | 6 |
| 17 | BC2 + 0.5% stearic acid | 110 | 110 | 100 | 50 | 16 | 10 | — | 5 |
| 18 | BC2 + 0.25% lauric acid | 140 | 140 | 130 | 95 | 60 | 20 | 10 | 6 |
| 19 | BC2 + 0.5% lauric acid | 140 | 130 | 120 | 80 | 50 | 20 | 10 | 6 |
| 20 | BC2 + 0.25% 12-HSA + 0.25% lauric acid | 130 | 120 | 110 | 80 | 50 | 20 | 10 | 6 |
| 21 | BC2 + 0.25% 12-HSA + 0.25% stearic acid | 130 | 110 | 60 | 0 | — | — | — | 3 |
| 22 | BC2 + 0.25% 12-HSA + 0.25% hysteric acid | 130 | 120 | 40 | 0 | — | — | — | 3 |
| 23 | BC2 + 0.125% 12-HSA + 0.125% stearic acid | 130 | 120 | 54 | 0 | — | — | — | 3 |
| 24 | BC2 + 0.125% 12-HSA + 0.125% hysteric acid | 130 | 120 | 60 | 0 | — | — | — | 3 |
| 25 | BC2 + 0.25% lauric acid and 0.25% stearic acid | 140 | 120 | 90 | 50 | 10 | — | — | 4 |

The data shown in table 3 can be interpreted as follows:

Examples 13 to 20 are outside the scope of the invention.

The base composition per-se needs six rinse-cylces. Addition of 0.25% by weight 12-HSA provides two rinse benefits. An increase renders the composition unstable (Example 15). This indicates that rinse benefits are not directly proportional to the amount of the hydroxy fatty acid.

The non-hydroxy fatty acids do not provide the desired technical effects. For example, at 0.25% by weight, stearic acid (C18 carboxylic acid) does not provide even a single rinse benefit. Neither stearic acid nor lauric acid provides the desired technical effects (Examples 16 to 19).

The data pertaining to Example 20 further reinforces the observation recorded for the corresponding formulation of Table 2 which is Example 10.

Examples 21-24 indicate that the technical benefits are not limited to one particular type of formulation. The combination of hydroxy and non-hydroxy fatty acids, as claimed, helps maintain the initial foam level while providing multiple rinse benefits which translates into substantial water savings which would have otherwise been used for rinsing the foam.

The data pertaining to Example 25 indicates that combination of two non-hydroxy fatty acids provides only two rinse benefits.

The invention claimed is:

1. An aqueous cleaning composition comprising:

(i) total Active Detergent (AD) level of 5 to 30% by weight, of which at least one-third is non-soap anionic surfactant; and, (ii) 0.1 wt % to 2 wt % of an antifoaming system containing saturated hydroxy fatty acid and saturated non-hydroxy $C_{14-18}$ fatty acid, where the ratio between the amount of said saturated hydroxy fatty acid to that of said saturated non-hydroxy $C_{14-18}$ fatty acid is from 1:0.75 to 1:5 parts by weight and where the pH of said composition is from 2 to 7.

2. A composition as claimed in claim 1 wherein said saturated hydroxy fatty acid is a monohydroxy fatty acid.

3. A composition as claimed in claim 1 wherein said saturated hydroxy fatty acid is 12-hydroxy stearic acid.

4. A composition as claimed in claim 1 wherein said saturated non-hydroxy $C_{14-18}$ fatty acid is a single acid or a combination of two or more $C_{14-18}$ fatty acids.

5. A composition as claimed in claim 1 wherein said composition comprises 0.25 to 1% by weight of said antifoam system.

6. A composition as claimed in claim 1 wherein said ratio is from 1:0.75 to 1:2 parts by weight.

7. A composition as claimed in claim 1 wherein said total AD level is 8 to 24% by weight.

8. A composition as claimed in claim 1 wherein of said total AD level, at least two-third is non-soap anionic surfactant.

9. A composition as claimed in claim 1 wherein said non-soap anionic surfactant is at least one of a linear alkyl benzene sulphonate or an ethoxylated sulphate.

* * * * *